US007141748B2

(12) United States Patent
Tanaka et al.

(10) Patent No.: US 7,141,748 B2
(45) Date of Patent: Nov. 28, 2006

(54) MULTIFUNCTIONAL SWITCH WITH INDICATOR

(75) Inventors: Kazumasa Tanaka, Isehara (JP); Kazuhiro Kikuya, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 11/037,466

(22) Filed: Jan. 19, 2005

(65) Prior Publication Data

US 2005/0224322 A1 Oct. 13, 2005

(30) Foreign Application Priority Data

Jan. 19, 2004 (JP) ..... 2004-010251

(51) Int. Cl.
*H01H 9/00* (2006.01)

(52) U.S. Cl. ..... 200/310; 200/566

(58) Field of Classification Search ..... 200/4, 200/5 R, 11 R, 14, 17, 18, 566, 310
See application file for complete search history.

(56) References Cited

U.S. PATENT DOCUMENTS 5,310,974 A * 5/1994 Churchill et al. ..... 200/566
5,916,288 A * 6/1999 Hartman ..... 701/36
6,274,835 B1 * 8/2001 Mo ..... 200/564
6,340,800 B1 * 1/2002 Zhai et al. ..... 200/5 R
6,660,947 B1 * 12/2003 Badescu ..... 200/4
6,722,869 B1 * 4/2004 Todokoro ..... 425/9
6,876,313 B1 * 4/2005 Hsiung et al. ..... 341/35
6,906,270 B1 * 6/2005 Roth et al. ..... 200/5 R
6,968,510 B1 * 11/2005 Yokota ..... 715/824
6,987,233 B1 * 1/2006 Cole et al. ..... 200/341
2004/0195080 A1 * 10/2004 Hagberg et al. ..... 200/4
2004/0245080 A1 * 12/2004 Turner ..... 200/329
2005/0077157 A1 * 4/2005 Sasanouchi et al. ..... 200/38 A

FOREIGN PATENT DOCUMENTS

FR 2 828 761 A 2/2003
JP 2003-054290 A 2/2003

* cited by examiner

*Primary Examiner*—Elvin Enad
*Assistant Examiner*—Lisa Klaus
(74) *Attorney, Agent, or Firm*—Foley & Lardner LLP

(57) ABSTRACT

A multifunctional switch with an indicator for selecting and switching a plurality of functions is disclosed. The multifunctional switch is provided with a dial knob capable of being pushed in an axial direction and rotated; a window formed at a center of the dial knob; an indicator configured to indicate a selected function; an indicator support configured to support the indicator and disposed at a rear of the dial knob, the dial knob being rotatably fitted on the indicator support and movable with the indicator support In the axial direction; and means for anti-rotation of the indicator support.

4 Claims, 4 Drawing Sheets

MULTIFUNCTIONAL SWITCH WITH INDICATOR

BACKGROUND OF THE INVENTION

1. Field of the Invention

The present invention relates to a multifunctional switch with an indicator, in which a plurality of functions can be selected by a combination of rotation of a dial knob and an operation of switches.

2. Description of the Related Art

Japanese Patent Application Laid-open No. 2003-054290 discloses a related art of a multifunctional switch with an indicator. According to the related art, the multifunctional switch is provided with a dial knob and a rotary encoder linked with a plurality of switches. Functions can be selected by rotating the dial knob. The dial knob is provided with a translucent window at a center thereof so that an operator can see an indicator (LCD) installed therein.

SUMMARY OF THE INVENTION

According to the aforementioned related art, the translucent window moves with the dial knob in a case where the dial knob is rotated and hence a relative distance between the translucent window and the indicator is necessarily changeable. Therefore it is necessary to give enough distance therebetween for operation of the dial knob.

Giving enough distance between the translucent window and the indicator leads to a decrease in an area and a drop in clearness for indication of the indicator.

The present invention is intended for providing a multifunctional switch with an indicator, in which a distance between the translucent window and the indicator can be unchangeable and set short so as to give clear view of the indicator.

According to an aspect of the present invention, a multifunctional switch is provided with a dial knob capable of being pushed in an axial direction and rotated; a window formed at a center of the dial knob; an indicator configured to indicate a selected function; an indicator support configured to support the indicator and disposed at a rear of the dial knob, the dial knob being rotatably fitted on the indicator support and movable with the indicator support in the axial direction; and means for anti-rotation of the indicator support.

Preferably, the multifunctional switch is further provided with a first tact switch including repulsive means so as to support and urge the indicator support toward the dial knob.

More preferably, the multifunctional switch is further provided with one or more second tact switches disposed around the dial knob and an indicia plate indicating the functions of the second tact switches, the indicia plate being interposed between the indicator and the dial knob.

Still preferably, the means for anti-rotation of the indicator support is a combination of one or more rails and one or more slots.

DETAILED DESCRIPTION OF THE PREFERRED EMBODIMENT

An embodiment of the present invention will be described hereinafter with reference to FIGS. 1 through 4.

Figure 4:
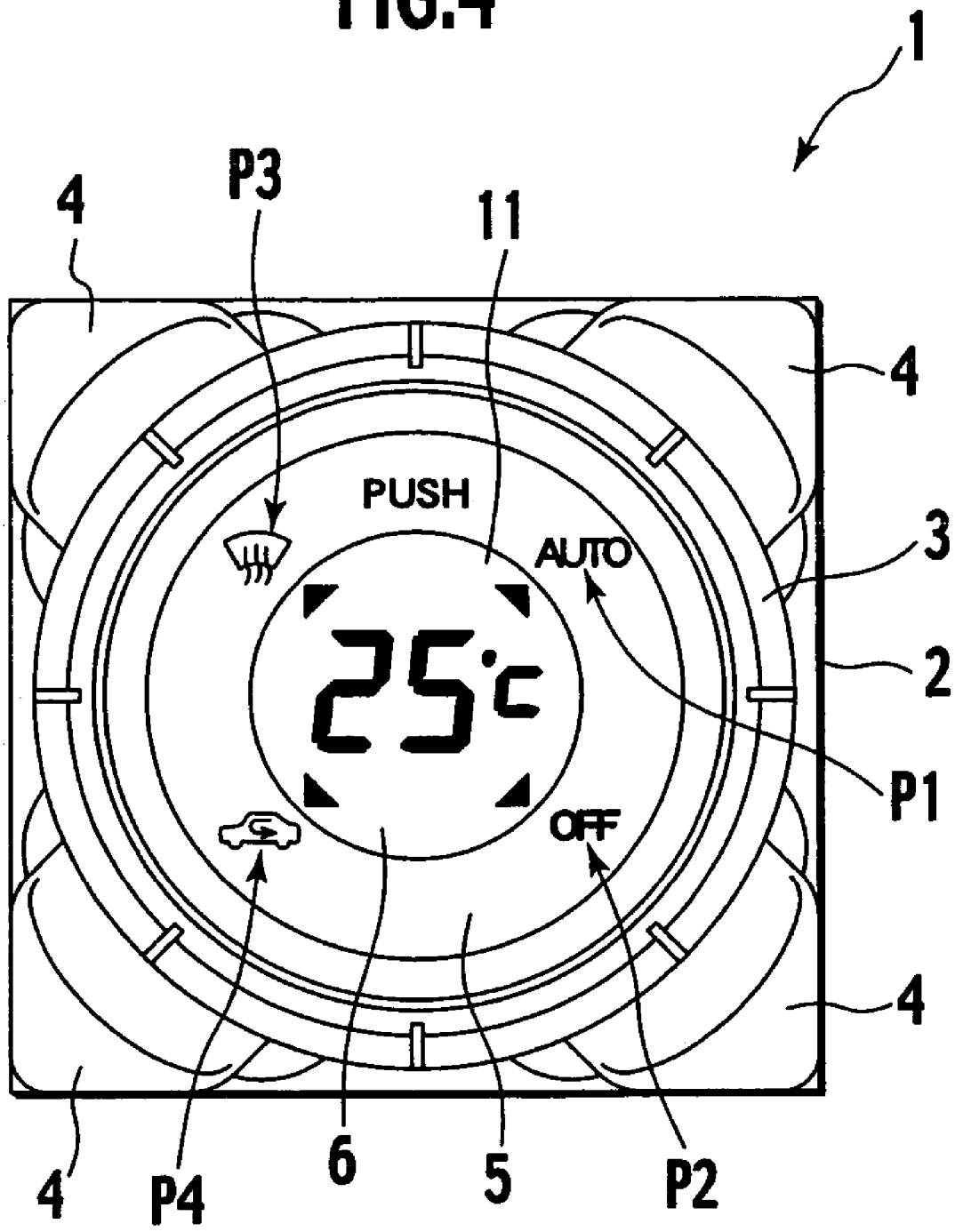
FIG. 4 is a front view of the multifunctional switch with the indicator.

A multifunctional switch 1 according to an embodiment of the present invention is applied to an automobile and preferably installed on an instrument panel of the automobile. The multifunctional switch 1 is provided with a casing 2, which has a rectangular cross section, a dial knob 3 disposed in front of the casing 2 and push buttons 4 respectively disposed on four corners of the casing 2 as shown in FIG. 4. The multifunctional switch 1 is installed in the automobile so that the front faces rearward with respect to a direction where the automobile moves.

The dial knob 3 is capable of being rotated and pushed with respect to the casing 2. Switches can be selected by a combination of such rotation and pushing operations. The push buttons 4 are also capable of being pushed with respect to the casing 2.

Figure 1:
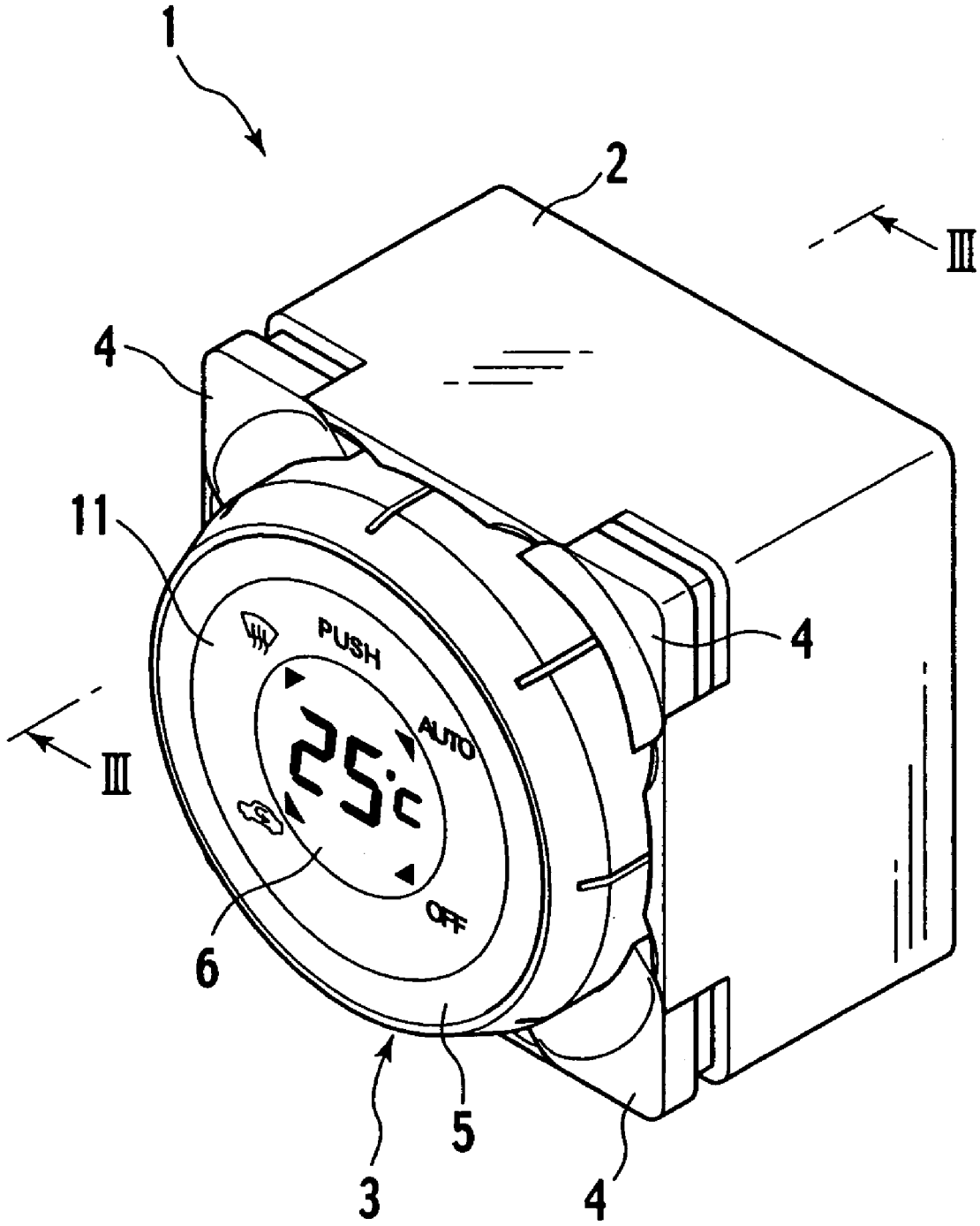
FIG. 1 is a perspective view of a multifunctional switch with an indicator according to an embodiment of the present invention.
Figure 2:
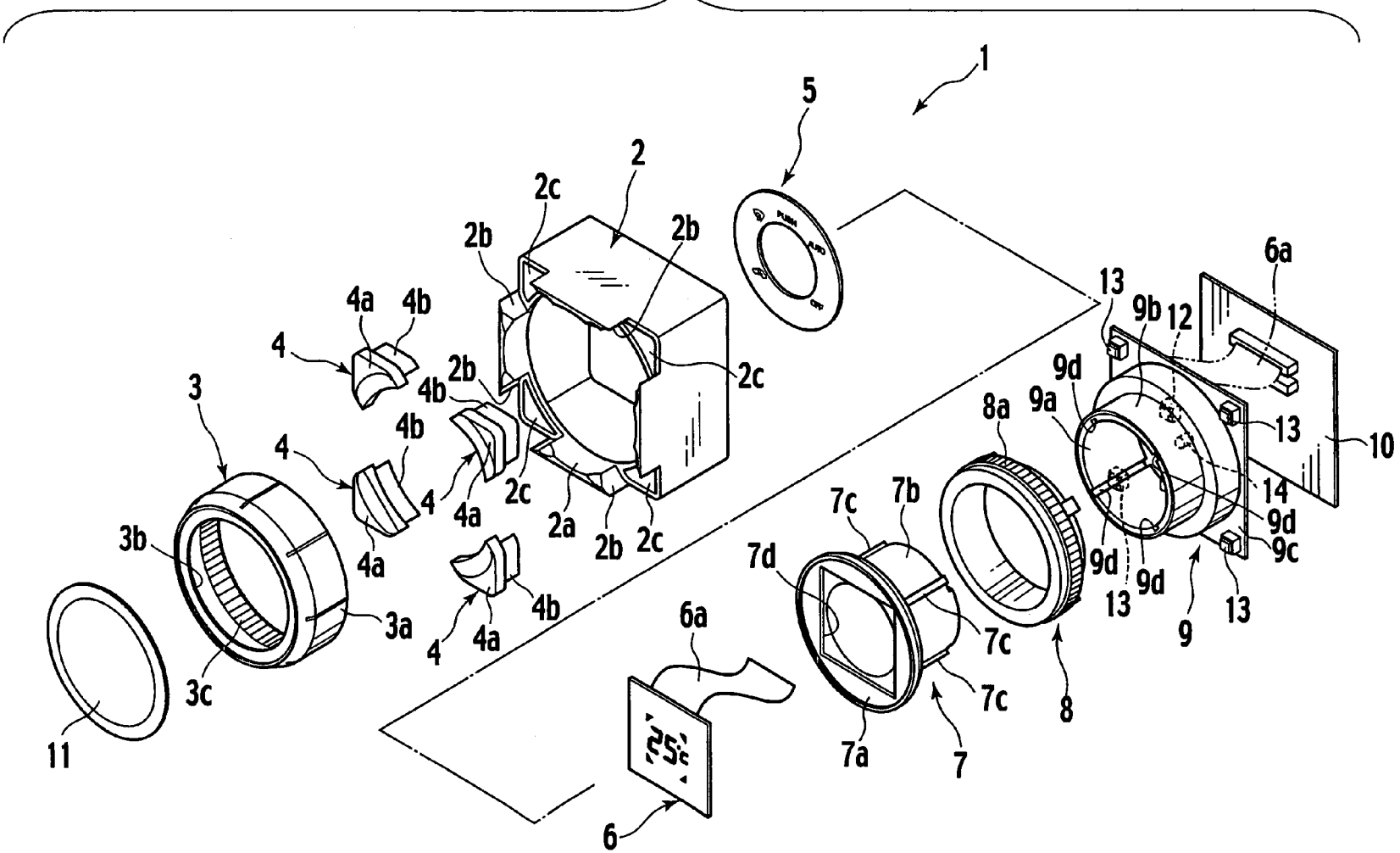
FIG. 2 is an exploded perspective view of the multifunctional switch with the indicator.

The multifunctional switch 1 is further provided with an indicia plate 5, on which black ink and some signs are printed, a liquid crystal display (LCD) plate 6 for an indicator, an indicator support 7, a transmission ring 8, a rotary encoder 9 and a back substrate 10 housed in the casing 2 as shown in FIG. 2.

The dial knob 3 is provided with a short cylindrical portion 3*a* and a tapered portion in front of the cylindrical portion 3*a*. A window 3*b* is coaxially formed in front of the tapered portion and at a center of the dial knob 3. A lens 11 is engaged in the window 3*b*. A serration 3*c* is formed on an inner periphery of the cylindrical portion 3*a* so as to engage with an outer periphery of the transmission ring 8.

The casing 2 is provided with fitting portions 2*a*, with which the outer surface of the cylindrical portion 3*a* of the dial knob 3 rotatably fits. The fitting portions 2*a* constitute a hypothetical cylindrical surface but four portions thereof, correspondingly to four corners of the casing 2, are cut-off so as to form cut-off sections 2*b*. Four corners of the casing 2 are respectively provided with insertion portions 2*c*, to which the push buttons 4 are respectively movably inserted.

Each of the push buttons 4 is provided with a button top 4*a*, which fits any of the cut-off sections 2*b*, and a proximal portion 4*b*, which is movably inserted into any of the insertion portions 2*c*. The operator utilizes the button top 4*a* for operation by his or her finger.

The indicator support 7 is disposed at a rear of the dial knob 3. The indicator support 7 is provided with a disk-like flange 7*a*, with which the dial knob 3 rotatably fits, and a cylindrical portion 7*b* projecting rearward (forward with respect to the direction where the automobile moves). The cylindrical portion 7*b* has a plurality of rails 7*c* (four rails are drawn in FIG. 2) running fore and aft on an outer circumference thereof The indicator support 7 is further provided with a rectangular recess 7*d*, in which the LCD plate 6 fits.

The LCD plate 6 has a rectangular shape so as to fit with the rectangular recess 7*d*.

The transmission ring 8 has a ring-like shape so as to fit in the interior of the dial knob 3 and has a serration 8*a* for engaging with the serration 3*c* of the dial knob 3. The serrations 3*c* and 8*a* are engaged with each other so that rotation of the dial knob 3 is transmitted to the transmission ring 8. The dial knob 3 is prevented from dropping off from the transmission ring 8 by means of anti-dropping means (not shown).

The rotary encoder 9 is provided with an inner fixed cylinder 9*a* and an outer rotary cylinder 9*b*. The inner fixed cylinder 9*a* is fixed with a main substrate 9*c* which is formed in a rectangular plate shape fitting with the interior of the casing 2. The outer rotary cylinder 9*b* is rotatably fitted with the inner fixed cylinder 9*a* and further prevented from axially displacing with respect to the inner fixed cylinder 9*a*. The rotary encoder 9 is configured to detect a rotation angle of the outer rotary cylinder 9*b* with respect to the inner fixed cylinder 9*a* so as to select switches.

The inner fixed cylinder 9*a* has a plurality of slots 9*d* (four slots drawn in FIG. 2) on an inner surface thereof. The rails 7*c* of the indicator support 7 slidably engage with the slots 9*d* so as to allow axial displacement of the dial knob 3 via the indicator support 7. The combination of the rails 7*c* and the slots 9*d*, as well, functions as means for anti-rotation of the LCD plate 6.

The main substrate 9*c* is provided with a first tact switch 12 and a plurality of second tact switches 13 in a manner that the first tact switch 12 faces to an end of the indicator support 7 and the second tact switches 13 respectively face to ends of the push buttons 4. The tact switches 12 and 13 respectively have return springs built therein. In a state that multifunctional switch 1 is integrated, the tact switches 12 and 13 touch the ends of the indicator support 7 and the push buttons 4 and repulsive forces of the return springs act on the indicator support 7 and the push buttons 4 via the tact switches 12 and 13.

The main substrate 9*c* is further provided with a back-light 14, to which a LED is applied, for illuminating the LCD plate 6. The back-light 14 is disposed at a center of the rotary encoder 9.

Figure 3:
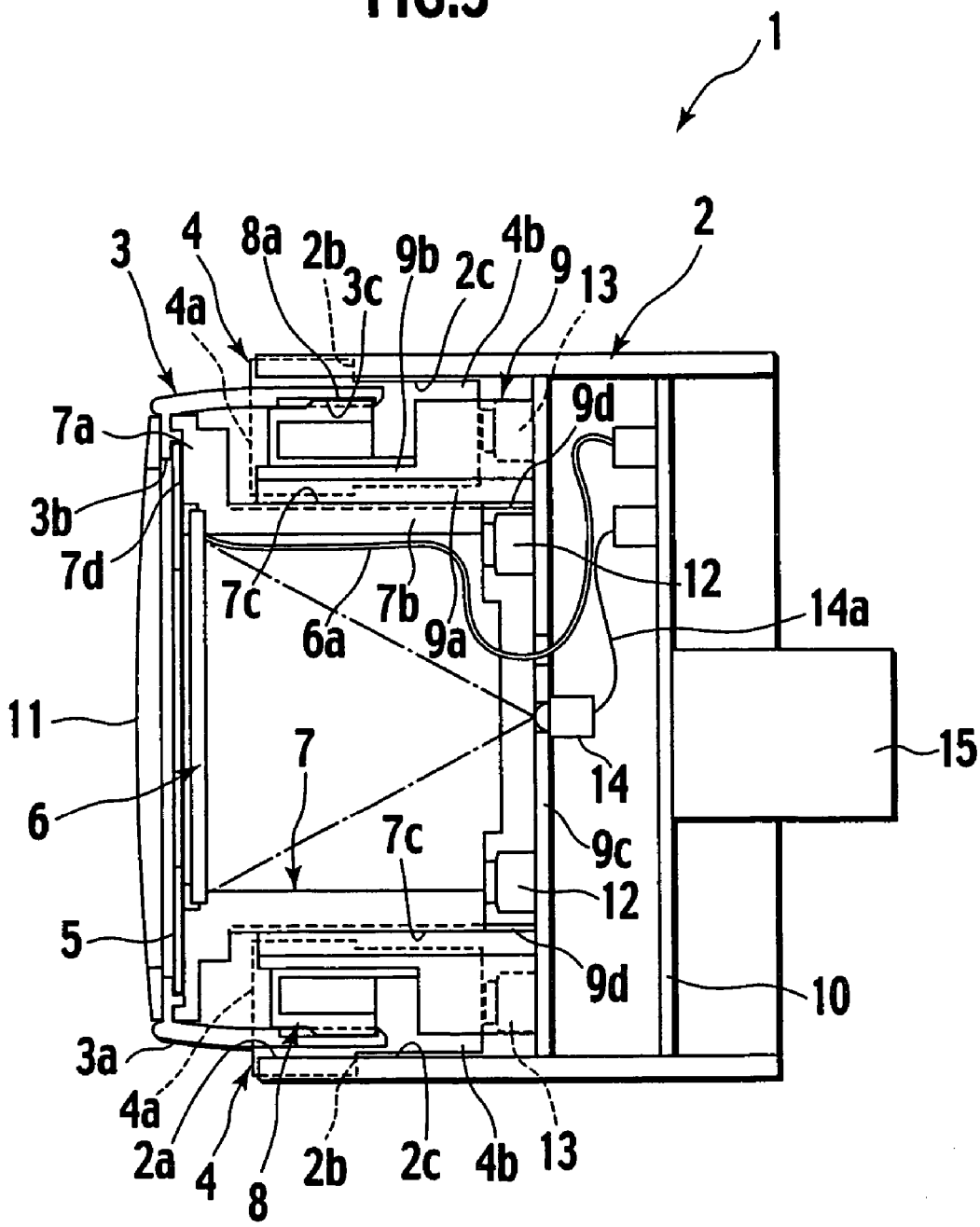
FIG. 3 is a cross sectional view, taken from a line III–III of FIG. 1, of the multifunctional switch with the indicator.

The back substrate 10 is fitted in and closes a substantially rearmost (foremost with respect to the direction where the automobile moves) end of the casing 2. The back substrate 10 is provided with a support projection 15 projecting from a rear surface thereof as shown in FIG. 3. A wiring harness 6*a* linking with the LCD plate 6 such as FPC and a wiring harness 14*a* linking with the back-light 14 are led rearward out of the back substrate 10.

The dial knob 3 fits with the disk-like flange 7*a* of the indicator support 7 with the LCD plate 6 put therebetween. The indicator support 7 is interposed between the dial knob 3 and the first tact switch 12 and hence urged toward the dial knob 3 by the repulsive force of the first tact switch 12.

The indicia plate 5 is interposed between the LCD plate 6 and the dial knob 3 and covers the periphery of the LCD plate 6. The indicia plate 5 is adhered to the LCD plate 6 by an adhesive for anti-rotation.

The indicia plate 5 indicates signs of respective functions of the pushbuttons 4 disposed around the dial knob 3. For example, as shown in FIG. 4, the indicia plate 5 indicates "AUTO" at a position P1, "OFF" at a position P2, a pictorial symbol of a defroster at a position P3 and a pictorial symbol of air recirculation at a position P4 with a white ink on a black background. The indicia plate 5 further indicates black triangles for pointing the respective push buttons 4.

When rotating the dial knob 3 the rotary encoder 9 reads the rotation angle and lets the LCD plate 6 indicate the function corresponding to the rotation angle.

By the aforementioned constitution, the first tact switch 12 can be operated by pushing the dial knob 3 via the indicator support 7 and the rotary encoder 9 can be operated by rotating the dial knob 3 via the transmission ring 8. The functions of the switches can be selected by the rotary encoder 9 by means of rotating the dial knob 3.

As being understood from the above description, a relative distance between the dial knob 3 and the LCD plate 6 is kept constant since the LCD plate 6 is supported between the dial knob 3 and the indicator support 7. Therefore the LCD plate 6 can be disposed close to the window 3*b* of the dial knob 3 and hence a relatively wide area of the LCD plate 6 is present to view through the window 3*b*. The operator can see the indication of the LCD plate 6 clearly.

Moreover, the constancy of the relative distance provides a freedom of selection of the lens 11. Since the relative distance is constant, any lens having a short focal length can be applied to the lens 11. Thereby the indication of the LCD plate 6 can be more clearly magnified.

Furthermore, in a case of rotating the dial knob 3, the LCD plate 6 is kept in an upright position since the indicator support 7 is anti-rotated with respect to the rotary encoder 9 by means of the combination of the rails 7*c* and the slots 9*d* and hence the operator can constantly see the indication in an upright state.

The LCD indicator 6 can be disposed further close to the window 3*b* of the dial knob 3 since the LCD indicator 6 is urged by the repulsive force of the first tact switch 12.

Particular back-lights for the indicia plate 5 are unnecessary since the indicia plate 5 is interposed between the LCD plate 6 and the dial knob 3 and the back-light 14 illuminates the indicia plate 5 as well as the LCD plate 6. Therefore the number of the back-lights installed therein can be reduced.

An operation feeling of the dial knob 3 can be controlled by properly controlling the coefficient of friction of the indicia plate 5.

The contents of Japanese Patent Application No. 2004-010251 (filed Jan. 19, 2004) are incorporated herein by reference in its entirety.

Although the invention has been described above by reference to certain embodiment of the invention, the invention is not limited to the embodiment described above. Modifications and variations of the embodiment described above will occur to those skilled in the art, in light of the above teachings.

What is claimed is:

1. A multifunctional switch with an indicator for selecting and switching a plurality of functions, the multifunctional switch comprising:

a dial knob capable of being pushed in an axial direction and rotated;

a window formed at a center of the dial knob;

an indicator configured to indicate a selected function;

an indicator support configured to support the indicator and disposed at a rear of the dial knob, the dial knob being rotatably fitted on the indicator support and movable with the indicator support in the axial direction; and means for anti-rotation of the indicator support.

2. The multifunctional switch of claim 1, further comprising a first tact switch including repulsive means so as to support and urge the indicator support toward the dial knob.

3. The multifunctional switch of claim 1, further comprising:

one or more second tact switches disposed around the dial knob; and an indicia plate indicating the functions of the one or more second tact switches, the indicia plate being interposed between the indicator and the dial knob.

4. The multifunctional switch of claim 1, wherein the means for anti-rotation of the indicator support comprises a combination of one or more rails and one or more slots.

* * * * *